United States Patent [19]

Gochanour

[11] Patent Number: 4,717,028

[45] Date of Patent: Jan. 5, 1988

[54] HANGER

[76] Inventor: Gary Gochanour, 3108 Baker Rd., Dexter, Mich. 48130

[21] Appl. No.: 908,425

[22] Filed: Sep. 16, 1986

[51] Int. Cl.[4] ..... A47F 5/08

[52] U.S. Cl. ..... 211/113; 211/124; 211/105.1

[58] Field of Search ..... 211/89, 133, 124, 113, 211/13, 66, 168, 105.1, 116; 223/96, 45

[56] References Cited

U.S. PATENT DOCUMENTS

| | | | |
|---|---|---|---|
| 632,077 | 8/1899 | Whitlock . | |
| 773,017 | 10/1904 | Keuffel | 211/124 |
| 1,253,852 | 1/1918 | Mankey | 211/60 R |
| 2,036,761 | 4/1936 | Krause | 211/113 |
| 2,210,631 | 8/1940 | Pearl . | |
| 2,553,710 | 5/1951 | Incampo | 211/113 |
| 2,902,173 | 9/1959 | Staffeld . | |
| 2,926,791 | 3/1960 | Hartley . | |
| 3,048,312 | 8/1962 | Birnbaum . | |
| 3,508,664 | 4/1970 | Lessard . | |
| 3,908,215 | 9/1975 | Watson | 211/11 |
| 4,209,879 | 7/1980 | Paajanen . | |

*Primary Examiner*—Reinaldo P. Machado
*Assistant Examiner*—Sarah A. Lechok Eley
*Attorney, Agent, or Firm*—Flynn, Thiel, Boutell & Tanis

[57] ABSTRACT

A garment hanger comprising spaced, curved divider members, each having a curved garment supporting surface and defining garment receiving spaces, and a pivotable, resiliently biased flap in each space for retaining a garment therein by the weight of the garment.

14 Claims, 8 Drawing Figures

HANGER

FIELD OF THE INVENTION

This application relates to a hanger, such as a garment hanger, adapted to be firmly mounted on a suitable support, such as a closet rod or a support rod in a clothing store. Particularly, the invention relates to a pant or skirt hanger in which the garment is suspended by its cuffs, its waistband or a fold therein, and is held suspended by means of a pivoting flap.

DISCUSSION OF PRIOR ART

Whitlock, U.S. Pat. No. 632,077, teaches a garment hanger which suspends a garment by means of a pivoting flap to hold a portion of the garment against a base plate by action of the garment's own weight.

Lessard in U.S. Pat. No. 3,508,664 teaches a pants rack using a pants own weight to hold it in place by the pinching action of a center support and a hinged pants holding member.

Hartley, U.S. Pat. No. 2,926,791, teaches a garment hanger in which the hanger is securely fastened to a closet rod.

Birnbaum, U.S. Pat. No. 3,048,312, shows a trousers hanger for supporting a plurality of trousers and constructed of a pair of outer slides with one portion of each slide featuring an opening through which a pair of heavy trousers may be inserted into an associated slot to facilitate hanging.

BRIEF SUMMARY OF THE INVENTION

According to this invention, there is provided a garment hanger adapted to be firmly mounted on a support, such as a closet rod, and especially suitable for hanging pants and/or skirts by their cuffs, waistbands, or a fold therein. The garment hanger comprises at least a pair of spaced-apart curved dividers, at least one of which has a curved garment-supporting surface. A downwardly opening garment-receiving space is defined between the lower ends of the spaced-apart dividers. A pivoting flap extends from a surface of one divider toward the garment-supporting surface of the other divider. The pivoting flap is constructed and disposed so that a garment is inserted into the garment-receiving space by being moved upwardly into the garment-receiving space from below or by being moved laterally inwardly from one lateral side of the garment-receiving space. Then, the garment is released, and the flap engages the garment to hold the garment securely against the garment-supporting surface of the adjacent divider by the garment's own weight. The flap is allowed to pivot through a limited arc so that it does not reach a fully upright vertical position. The pivoting flap may be constructed with a relatively weak leaf-like spring element to provide a weak closing force on the flap sufficient to overcome the friction of the flap's hinge at its base. Usually, a garment hanger comprises a plurality of spaced dividers, so as to be capable of holding a plurality of garments in side-by-side relation.

DETAILED DESCRIPTION OF THE PREFERRED EMBODIMENTS

Figure 1:
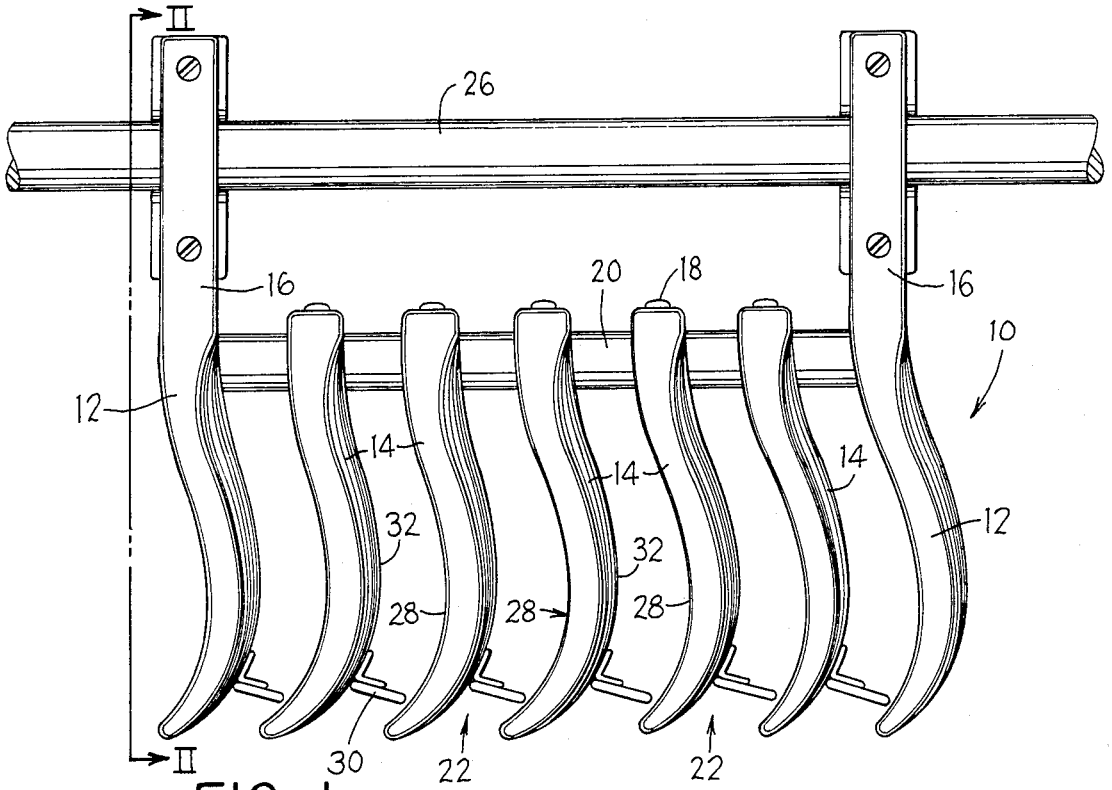
FIG. 1 is a front elevational view of a garment hanger constructed according to this invention.
Figure 2:
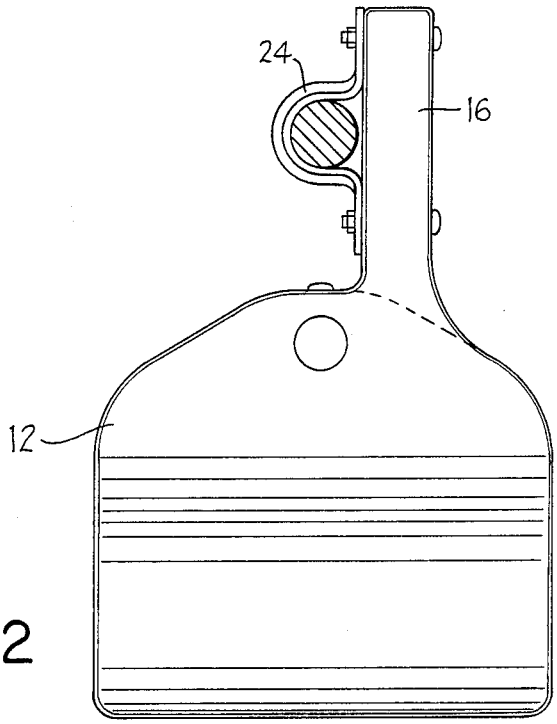
FIG. 2 is a side view of the garment hanger of FIG. 1 taken along the line II—II.

Looking now at FIGS. 1 and 2 of the drawing, there is illustrated a garment hanger 10 comprising a pair of upright end divider members 12 and a plurality of similarly curved paddle-shaped spaced-apart interior divider members 14, all of which are substantially laterally aligned and parallel with each other. Each end divider member 12, as shown in FIG. 2, has a rod connecting part 16 extending vertically upwardly therefrom to facilitate attachment of the garment hanger to a closet rod, or other support structure. The interior divider members 14, disposed between the end divider members, are each connected by fastening means 18, such as screws, dowels and the like, to a longitudinal member 20 that extends between and is connected in any suitable manner at its ends to the end divider members 12. The longitudinal member 20 provides a rigid support to which the interior dividers 14 are affixed in a stationary spaced-apart relationship. Downwardly opening garment-receiving spaces 22 are defined between immediately adjacent spaced-apart divider members 12 and 14. U-shaped clamping brackets 24 (see especially FIG. 2) fastened, as with bolts, to the connecting parts 16 are provided to firmly secure the hanger 10 to a closet rod 26 thereby preventing the garment hanger from swiveling around or lifting off the closet rod 26 when a garment is inserted into the garment-receiving space between the dividers. Each end divider member 12 and each interior divider member 14 is provided with a curved, somewhat J-shaped, garment-supporting surface 28. The lower ends of the divider members 12 and 14 are curved so that the garment-supporting surface 28 is concave in a direction facing toward one end of the garment hanger, here the leftward end as appearing in FIGS. 1 and 2. The opposite surfaces 32 of the divider members 12 and 14, that is, the rightward surfaces in FIGS. 1 and 2, are convex surfaces which are substantially parallel with the concave surfaces. It is to be noted, however, that the concave and convex surfaces 28 and 32 converge to a narrow tip at the lower end thereof. A garment inserted in the garment-receiving space 22 will contact the adjacent divider at the lower curved portion of the divider's concave garment-supporting surface 28. The outer (leftward) surface of the left-hand end divider member 12 does not function to support a garment, but the member is shaped the same as the right-hand end divider member for economy of manufacture.

Figure 3:
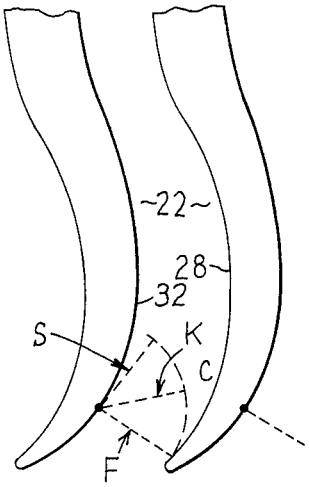
FIG. 3 is a diagrammatic representation of a fragment of the hanger of FIG. 1 showing selected positions of the garment retaining pivoting flap.

An elongated pivotable flap 30 is mounted on the surface 32 of each divider member 12 and 14, except the rightward end divider member 12. Each flap 30 extends across the space between the surface 32 on which it is mounted and the concave garment-supporting surface 28 of the immediately adjacent divider member. The flaps 30 are each pivotally hinged along one longitudinal edge thereof to the surface 32 of their respectively associated divider members. The flap 30 extends transversely toward the garment-supporting surface 28 of the adjacent divider so that its other longitudinal edge 30A (FIG. 6) lightly touches or is just slightly spaced from the garment-supporting surface 28 whereby said flap spans the garment-insertion space 22 between adjacent dividers. In its resting position F (see FIG. 3), owing to gravity, each flap 30 is generally perpendicular to the tangent on the surface 32 from which it extends; when a garment is pushed upwardly into the space 22, the flap 30 is moved to a position S, which does not fully reach the vertical direction. In the garment-holding position, the flap is in an intermediate position K between positions F and S. The ultimate garment-holding position of the flap 30 will depend on the thickness or bulk of the garment.

Figure 4:
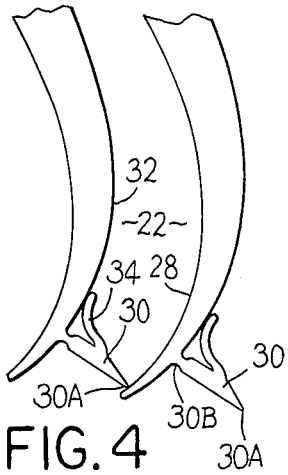
FIGS. 4 and 5 are views similar to FIG. 3 and showing different forms of pivoting flaps according to this invention.
Figure 5:
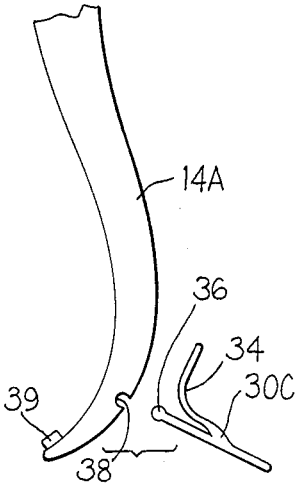

The pivotable flap 30 can be constructed with a weak leaf-like spring portion 34, as shown in FIGS. 4 and 5, which biases the flap 30 for movement to position F for engaging the surface 32. When the flap 30 is pivoted, it cannot be pivoted to a fully upright vertical position. The spring 34 provides a weak closing force on the flap 30 sufficient to overcome the friction of the hinge at the base of the flap. To withdraw a garment from the hanger only requires the pivoting of a flap toward the position S and away from the garment.

The flaps 30, including their weak leaf-like springs 34, when used, can be formed integral with the divider members, as illustrated in FIG. 4, in which a portion 30B of reduced thickness in the flap 30 provides a hinge for the flap. Alternatively, the divider and flap members can be formed separately from one another, as illustrated in FIG. 5. The flap 30C of FIG. 5 is formed with an enlarged hinging end 36 which snaps into a complementary shaped groove 38 in the divider member. The hinge for the flap 30C is provided by the joint, i. e., the enlarged end 36 and the groove 38.

Figure 6:
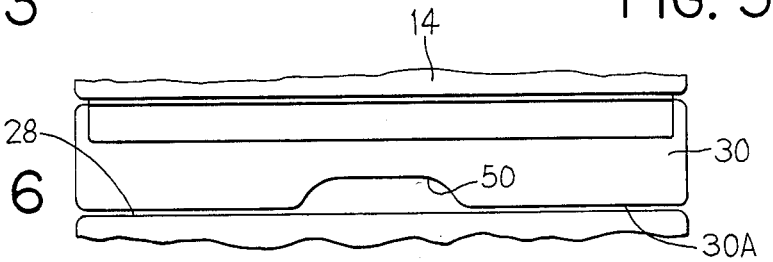
FIG. 6 is a partial top view of a garment retaining pivoting flap.

In all forms of flaps, an indent 50 can be provided on the edge of the flap which contacts the garment, as shown in FIG. 6, to accommodate the seam of the garment, such as a pant seam.

A non-skid strip 39 (FIG. 5) can be provided close to the lower edge of the garment-supporting surface 28 to cooperate with the flap 30 on the adjacent divider whereby to minimize the possibility that the garment will slide off the garment hanger.

Figure 7:
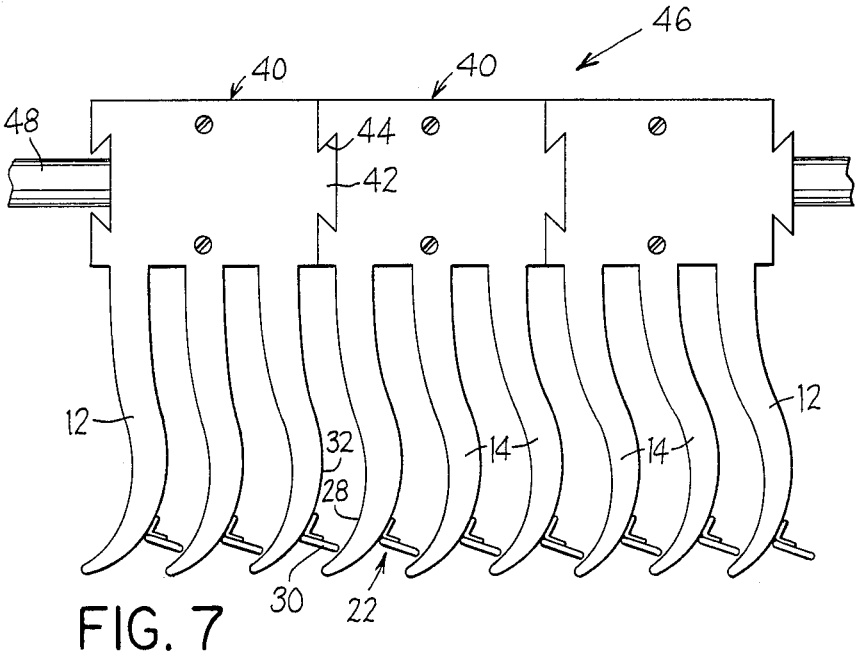
FIG. 7 is a side view of another form of garment hanger according to this invention.

Another embodiment of the garment hanger is shown in FIG. 7, wherein a plurality of hanger units 40, each having one or more dividers are toggled together by means of a generally keystone or key-shaped projection 42 interlocking in a complementary shaped recess 44 to form an assembly 46 of units 40 by slide fitting the units together in tongue and groove fashion. While a keystone shaped tongue and correspondingly shaped groove surface are shown here, it is within the scope of the invention to include all other interlocking shapes such as squares, rectangles, triangles and other polygonal shapes and cylinders. The assembly 46 can then be connected to a closet rod 48 with U-shaped brackets in the same manner as the hanger of FIGS. 1 and 2. The dividers and the pivoting flaps of this embodiment are constructed in the same manner as similar parts in the first embodiment and thus the same reference characters are used to identify like parts in both embodiments. It is to be understood that each unit can be constructed with more than or less than three dividers as shown to be toggled together to form an assembly of units without departing from the spirit of the invention.

Figure 8:
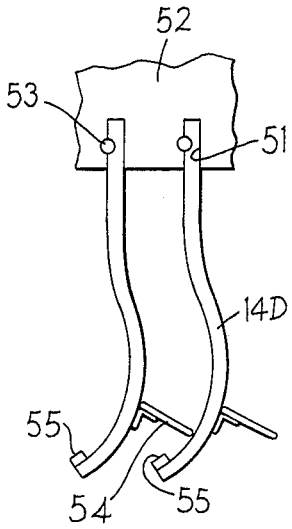
FIG. 8 is a side view of still another garment hanger according to the invention.

FIG. 8 illustrates yet another embodiment of the invention in which the divider members 14D are made of sheets of uniform thickness. The upper ends of the divider members 14D are slid laterally into slots 51 in the hanger unit 52 and are releasably locked in place by pins 53. The flaps 54 and the non-skid strip 55 cooperate with each other as described above.

The various parts of the garment hanger of this invention can be constructed any suitable material, including plastics which can be injection molded or manufactured by other suitable plastic forming processes.

The garment hanger according to the invention has a number of important advantages in comparison with the conventional garment hangers, including the following:

1. The operation of this garment hanger does not require any manual manipulation of parts of the hanger. Both hands of the user are free to hold the garment during insertion and removal. Insertion and removal of the garment is quick and convenient and it can be done without affecting other garments that are already being on the unit.

2. The capacity of the unit is readily expandable by adding more dividers.

3. The structure is simple because no manually adjustable clamps, springs, etc. are employed. The unit can hold thick or thin garments readily and without structural modification because of the curvature of concave garment-supporting surface 28 and its relationship to the flap 30. The flap is always maintained in a position in which it is free to move downwardly by gravity to its lowermost garment-gripping position.

4. The garment hanger does not leave a crease or mark on the garment. The same garment hanger will hold pants or shirts.

Although the foregoing description has referred to use for hanging garments, and such is preferred, it will be evident that it can be used to support other thin flat objects, for example, auto floor mats.

Although particular preferred embodiments of the invention have been disclosed in detail for illustrative purposes, it will be recognized that variations or modifications of the disclosed apparatus, including the rearrangement of parts, lie within the scope of the present invention.

I claim:

1. A garment hanger adapted to be connected to a closet rod, comprising at least a pair of similarly curved paddle-shaped dividers in fixed parallel spaced-apart relation to one another, said dividers having opposed upright surfaces defining a downwardly opening garment-receiving space therebetween, one of said surfaces being concave and the other of said surfaces being correspondingly convex and substantially parallel with said concave surface, a pivotable garment engaging flap extending between each pair of dividers, means for rigidly holding said dividers in said spaced-apart relation, said holding means comprising a member extending between said dividers and to which said dividers are rigidly connected, and means for rigidly fixing said garment hanger to a closet rod, said fixing means comprising a member projecting from at least one of said dividers and adapted for engaging a closet rod, each of said curved paddle-shaped dividers having a said concave surface and a said convex surface on opposite sides thereof, said dividers being disposed so that said concave surfaces on all of said dividers face a single linear direction and said convex sufaces on all of said dividers face the opposite linear direction, each flap being pivotedly mounted at one end thereof on the convex surface of its associated pair of dividers close to the lower end thereof and extending across the space between its associated pair of dividers toward the concave surface of its associated pair of dividers so that the opposite end of said flap is normally disposed close to said concave surface at a loation close to the lower end thereof to engage and support a garment against the concave surface of its associated pair of dividers, said flap being pivotable upwardly in said garment-receiving space so that the spacing between said opposite end of said flap and said concave surface progressively increases in an upward direction as said flap is pivoted upwardly in said space.

2. A hanger as recited in claim 1, wherein said flap is resiliently biased.

3. A hanger as recited in claim 2, further comprising a leaf-like spring means for urging said flap toward a position engaging a garment when a garment is inserted into said receiving space.

4. A hanger as recited in claim 3, wherein said pivotable flap and said leaf-like spring means are integral.

5. A hanger as recited in claim 4, wherein said flap and said leaf-like spring means are integral with said next adjacent divider.

6. A hanger as recited in claim 5, wherein said flap is provided with a portion of reduced thickness providing a hinge therefor.

7. A hanger as recited in claim 4, wherein said flap and said leaf-like spring means are formed separately from said next adjacent divider and are mechanically connected thereto.

8. A hanger as recited in claim 1, further comprising an array of said dividers connected together and defining a plurality of said receiving spaces, each space having therein a pivotable flap to support garments.

9. A hanger as recited in claim 1, further comprising an assembly of a plurality of hanger units, each unit comprising a plurality of said dividers, each unit being joined to a next adjacent unit.

10. A hanger as recited in claim 1, wherein said fixing means further comprises a U-shaped bracket for clamping engagement over a closet rod.

11. A garment hanger as claimed in claim 1, wherein said flap is adapted to pivot in a limited arc so that it cannot be pivoted to a fully upwardly vertical position.

12. A garment hanger as claimed in claim 1, wherein said flap has a recessed portion in the edge thereof adjacent said concave surface and adapted for accomodating a garment seam.

13. A hanger as claimed in claim 1 including a non-skid strip along the lower edge of said concave garment-supporting surface and adapted for gripping cooperation with said flap.

14. A hanger as described in claim 1, wherein said pivotable flap is adapted to engage said concavely curved supporting surface at a location lower than the site at which said pivotable flap is hinged to the adjacent divider member.

* * * * *